US008021997B2

(12) United States Patent
Groten et al.

(10) Patent No.: US 8,021,997 B2
(45) Date of Patent: Sep. 20, 2011

(54) MULTICOMPONENT SPUNBONDED NONWOVEN, METHOD FOR ITS MANUFACTURE, AND USE OF THE MULTICOMPONENT SPUNBONDED NONWOVENS

(75) Inventors: Robert Groten, Sundhoffen (FR); Ulrich Jahn, Labaroche (FR); Georges Riboulet, Colmar (FR)

(73) Assignee: Carl Freudenberg KG, Weinheim (DE)

( * ) Notice: Subject to any disclaimer, the term of this patent is extended or adjusted under 35 U.S.C. 154(b) by 151 days.

(21) Appl. No.: 11/185,322

(22) Filed: Jul. 20, 2005

(65) Prior Publication Data

US 2006/0019570 A1 Jan. 26, 2006

(30) Foreign Application Priority Data

Jul. 24, 2004 (DE) ..... 10 2004 036 099

(51) Int. Cl.
*D04H 3/16* (2006.01)

(52) U.S. Cl. ..... 442/401; 442/361; 442/415

(58) Field of Classification Search ..... 442/361, 442/401, 415
See application file for complete search history.

(56) References Cited

U.S. PATENT DOCUMENTS

| | | | | |
|---|---|---|---|---|
| 5,679,042 | A | 10/1997 | Varona | 442/347 |
| 5,759,926 | A * | 6/1998 | Pike et al. | 442/333 |
| 5,783,503 | A | 7/1998 | Gillespie et al. | 442/340 |
| 5,899,785 | A | 5/1999 | Groten et al. | 442/344 |
| 6,053,719 | A | 4/2000 | Barbier et al. | 425/81.1 |
| 6,352,948 | B1 * | 3/2002 | Pike et al. | 442/384 |
| 6,613,704 | B1 * | 9/2003 | Arnold et al. | 442/361 |
| 6,706,652 | B2 | 3/2004 | Groten et al. | 442/327 |
| 6,815,382 | B1 | 11/2004 | Groten et al. | 442/340 |
| 2002/0028623 | A1 | 3/2002 | Carlson et al. | 442/361 |
| 2003/0091822 | A1 * | 5/2003 | Bond et al. | 428/373 |
| 2004/0222545 | A1 | 11/2004 | Reibel et al. | 264/103 |

FOREIGN PATENT DOCUMENTS

| | | |
|---|---|---|
| CN | 1171463 | 1/1998 |
| DE | 196 30 523 | 5/1998 |
| DE | 697 03 983 | 8/2001 |
| EP | 0 814 188 | 12/1997 |
| EP | 0 914 508 | 1/2001 |
| EP | 1 118 305 | 7/2001 |
| EP | 1 428 919 | 6/2004 |
| EP | 1 054 096 | 9/2004 |
| JP | A7-26454 | 1/1995 |
| JP | A9-209254 | 8/1997 |
| JP | A10-53948 | 2/1998 |
| JP | A10-110373 | 4/1998 |
| JP | A11-247058 | 9/1999 |
| JP | A2000-110060 | 4/2000 |
| WO | WO 01/07698 | 2/2001 |
| WO | WO 01/64478 | 9/2001 |
| WO | WO2004/09347 | 1/2004 |
| WO | WO 2004/093747 | 1/2004 |

OTHER PUBLICATIONS

Office Action for Japenese Patent Application No. 2005-214841 mailed on Aug. 13, 2008.

* cited by examiner

*Primary Examiner* — Jenna Johnson
(74) *Attorney, Agent, or Firm* — Pearl Cohen Zedek Latzer, LLP

(57) ABSTRACT

A multicomponent spunbonded nonwoven is provided which is composed of at least two polymers which form interfaces toward one another, which are produced by at least one spinning machine having uniform spinning nozzle apertures, and which are hydrodynamically drawn, lapped in a sheet-like manner, and bonded, the multicomponent spunbonded nonwoven being composed of different filaments which contain at least two polymers, or it being composed of a mixture of multicomponent filaments and monocomponent filaments which each contain only one of the polymers, the multicomponent filament being composed of at least two elementary filaments and the titer of the individual filaments varying by the number of elementary filaments contained in the filaments.

23 Claims, 3 Drawing Sheets

| **Split titer * [decitex]** | **0.58** | **0.41** | **0.31** | **0.21** | **0.2** | **0.19** | **0.16** | **0.15** | **0.11** | **0.10** | **0.09** | **0.05** |
|---|---|---|---|---|---|---|---|---|---|---|---|---|
| Test no. | 1184 | 1185 | 1186 | 1188 | 1187 | 1194 | 1193 | 1189 | 1195 | 1190 | 1191 | 1192 |
| Starting titer/seg [decitex] | 4.6/8 | 3.3/8 | 2.5/8 | 1.7/8 | 1.6/8 | 3.1/16 | 2.5/16 | 4.7/32 | 1.7/16 | 3.3/32 | 2.9/32 | 1.7/32 |
| cN/T before split | 22.9 | 23.1 | 20.7 | 21.3 | 19.7 | 24.6 | 23.2 | 26.0 | 21.3 | 26.2 | 22.6 | 28.0 |
| Elongation | 63.6 | 68.9 | 63.7 | 61.5 | 59.0 | 74.6 | 74.6 | 63.9 | 72.0 | 74.5 | 83.0 | 85.2 |
| | | | | | | | | | | | | |
| Look A/B | 10/5 | 15/10 | 15/10 | — | 15/14 | 15/11 | 15/12 | 14/11 | 14/13 | 14/11 | 14/11 | 13/11 |
| Feel [grade] | 5 RK | 5 RK | 9 | — | 10 | 10 | 10 | 10 | 10 | 10 | 10 | 10 |
| Split degree [%] | 80 | 80 | 80 | — | 80 | 98 | 95 | 95 | 95 | 98 | 99 | 99 |
| | | | | | | | | | | | | |
| Weight [kg] $10^{-3}$ | 117 | 110 | 114 | — | 100 | 117 | 116 | 117 | 111 | 110 | 115 | 109 |
| Thickness [m] $10^{-3}$ | 0.62 | 0.57 | 0.55 | — | 0.50 | 0.59 | 0.53 | 0.61 | 0.52 | 0.55 | 0.55 | 0.53 |
| Density [kg/m$^3$] | 188.7 | 193.0 | 207.3 | — | 200 | 198.3 | 218.9 | 191.8 | 213.5 | 200 | 209.1 | 205.7 |
| WRK (I+q)/2 x weight | 0.155 | 0.105 | 0.085 | — | 0.055 | 0.075 | 0.06 (??) | 0.065 | 0.055 | 0.055 | 0.085 | 0.04 |
| HZK (I+q)/2 x weight | 3.14 | 3.23 | 3.19 | — | 2.70 | 3.22 | 3.02 | 3.10 | 2.51 | 2.70 | 2.25 | 1.74 |
| Elongation [%] (I+q/2) | 50 | 53 | 52 | — | 48 | 47 | 47 | 43 | 46 | 41 | 40 | 36 |
| Module 5% (spec.) | 0.47 | 0.53 | 0.55 | — | 0.49 | 0.58 | 0.62 | 0.59 | 0.44 | 0.59 | 0.48 | 0.44 |
| Abrasion [grade] | 3/2 | 3/3 | 2/2 | — | 2/1 | 3/2 | 2/1 | 2/1 | 2/2 | 2/1 | 1/1 | 1/1 |

FIGURE 1 : Physical textile properties of the obtained fabrics of the test series of the Comparative Example

| **Layers x Ø Titer [decitex]** | 5 x 0.15<br>2 x 2.3<br>5 x 0.15 | 4 x 0.15<br>4 x 0.3<br>4 x 0.15 | 4 x 0.3<br>4 x 0.15<br>4 x 0.08 | 2 x 2.5<br>2 x 1.25<br>2 x0.3<br>2 x 0.15<br>4 x 0.08 |
|---|---|---|---|---|
| Example | 1(a) | 1(b) | 2(a) | 2(b) |
| | | | | |
| Look A/B | 13 / 10 | 14 / 13 | 12 / 14 | 9 /14 |
| Split degree* [%] | 90 | 95 | 90 | 90 |
| * of the splittable filaments | | | | |
| Weight [kg] $10^{-3}$ | 105 | 107 | 102 | 110 |
| Thickness [m] $10^{-3}$ | 0.60 | 0.58 | 0.49 | 0.64 |
| Density [kg/m$^3$] | 175 | 184.5 | 208 | 172 |
| WRK (I+q)/2xweight | 0.156 | 0.077 | 0.064 | 0.190 |
| HZK (I+q)/2xweight | 2.63 | 3.11 | 2.53 | 2.76 |
| Elongation [%] (I+q)/2 | 52 | 46 | 47 | 49 |
| Module 5% (spec.) | 0.56 | 0.55 | 0.50 | 0.43 |
| Abrasion [school grade] | 2 / 1 | 1 / 1 | 2 / 1 | 3 / 1 |

Figure 3: Physical textile properties of the fabrics of Examples 1(a-b) and 2(a,b)

MULTICOMPONENT SPUNBONDED NONWOVEN, METHOD FOR ITS MANUFACTURE, AND USE OF THE MULTICOMPONENT SPUNBONDED NONWOVENS

Priority is claimed to German Patent Application No. DE 10 2004 036 099.5, filed on Jul. 24, 2004, the entire disclosure of which is incorporated by reference herein.

FIELD OF THE INVENTION

The present invention relates to multicomponent spunbonded nonwovens, to a method for manufacturing such a multicomponent spunbonded nonwoven, and to the use of the subsequently obtained products.

BACKGROUND

Physical textile properties of webs are controlled via the chemical and physical textile properties of the fibers and filaments which form them. The fiber or filament raw materials are selected based on the desired chemical and physical properties, with regard to their ability to be dyed, their chemical resistance, their thermal ductility, or their absorption capability. The module and stress-strain properties of the fibers or filaments are dependent on the material properties which may be controlled via the selection of the degree of crystallization and/or the degree of orientation and the profile geometry in order to influence the bending rigidity, the power, or the specific surfaces of the individual fibers or filaments. The sum of the physical textile properties of the fibers or filaments forming a fabric is ultimately controlled via the mass per unit area. Examples of oppositional demands on fabrics are geotextiles made of highly rigid, highly drawn, large-titrant, and three-dimensionally woven filaments, e.g., chewing tobacco pouches made of cellulosic wet nonwoven fleece, or nylon hose made of a fine, texturized polyamide fabric.

Nonwovens made of very fine continuous filaments, which are manufactured using bi-component continuous filaments, are known from EP 0 814 188 B1 in which the two components viewed in cross section are situated in an orange wedge formation in an alternating manner in the starting filament and, after lapping to form a fabric, are split up into microfiber filaments via liquid pressure jets and are simultaneously bonded by entangling the filament strands. The obtained multicomponent spunbonded nonwoven is determined by the physical textile properties of its two types of elementary filaments, the titers of both elementary filaments diverging only slightly from one another.

An additional way to combine oppositional properties in one fabric is to manufacture composites made up of two or more fabrics. The individual properties are combined by joining the individual fabrics via known joining methods such as sewing, gluing, laminating. For this purpose, the individual fabrics have to be manufactured separately and are subsequently joined together. U.S. Pat. No. 5,679,042 describes a method for manufacturing a nonwoven having a fiber structure, which has a pore size gradient, the fibers, made of at least one polymer resin, being produced and lapped to form a nonwoven having an average pore size and a selective treatment, using a heat source, being subsequently performed, thereby resulting in shrinkage of the fibers and reduction of the average pore size.

SUMMARY OF THE INVENTION

The object of the present invention is to provide a multicomponent spunbonded nonwoven which combines different physical textile properties. Furthermore, the object of the present invention is to provide a method for manufacturing such a multicomponent spunbonded nonwoven, as well as the use of the subsequently obtained multicomponent spunbonded nonwovens.

According to the present invention, the object is achieved by a multicomponent spunbonded nonwoven which is composed of at least two polymers, which form interfaces toward one another, which emanate from at least one spinning machine having uniform spinning nozzle apertures, and which are hydrodynamically drawn, lapped in a sheet-like manner, and bonded. The multicomponent spunbonded nonwoven is composed either of different filaments which contain at least two polymers, or of a mixture of multicomponent filaments and monocomponent filaments which each contain only one of the polymers. The multicomponent filament includes at least two elementary filaments and the titer of the individual filaments varies by the number of elementary filaments contained in the filaments. The multicomponent spunbonded nonwoven according to the present invention therefore has the advantage that it combines different filaments which differ with regard to the polymers of which they are made and with regard to their filament titer, although they are produced by a uniform spinning process. This makes it possible to achieve the advantage over the known related art that the separate manufacture of spunbonded nonwovens having different filament titers does not have to take place separately and that no subsequent combination is necessary in order to obtain a multicomponent spunbonded nonwoven which is composed of different filaments having different filament titers.

According to the present invention, the multicomponent filaments, which are present in the multicomponent spunbonded nonwoven according to the present invention, may be composed of 1 to 64 elementary filaments. The titer of the elementary filaments may be in the range of 0.05 to 4.8 decitex. The wide range of the filament titer results in the fact that, due to the fine-titrant portion, products having very small pore sizes are obtained and that the physical textile properties of the multicomponent spunbonded nonwoven are determined by the content of filaments having a large titer.

The monocomponent filaments and the multicomponent filaments of the multicomponent spunbonded nonwoven advantageously have a similar starting titer in the range of 1.5 to 5 decitex. The use, according to the present invention, of uniform spinning plates for manufacturing monocomponent filaments and multicomponent filaments having similar starting titers in the range of 1.5 to 5 decitex is a cost-efficient and, with regard to the spinning conditions, effective measure.

The polymers used in the multicomponent spunbonded nonwoven of the present invention are preferably present with the same weight ratio in the multicomponent filaments and in the mixture of the monocomponent filaments. The effective utilization of a supply system for the individual spinning machines is made possible by the use, according to the present invention, of the same weight ratio of the polymers in the different filaments, i.e., in the simplest case, only one extruder for one of the used polymers is necessary for the parallel production of the different monocomponent filaments and multicomponent filaments. By using additional extruders, correspondingly more polymer components may be used.

Due to the lamination of monocomponent filaments and elementary filaments, obtained from the multicomponent filaments after their split up, or of at least two layers of multicomponent filaments having a different number of elementary filaments and a consequently different titer of the elementary filaments, the multicomponent spunbonded nonwoven according to the present invention advantageously has a titer gradient perpendicular to its main surfaces, i.e., in the z direction. The filaments having different titers may be distributed in such a way with respect to thickness that, for example, the filaments with the largest titer are in the center of the multicomponent nonwoven of the present invention and that the filaments with decreasing titer are arranged in a graduated manner to the outside, or the filament titer is distributed in such a way that the titer increases or decreases from one main side in the direction of the other main side.

The polymers used in the multicomponent spunbonded nonwoven of the present invention advantageously contain insoluble additives such as pigments, fillers, light protective agents, as well as soluble additives. The use of the named additives in the used polymers allows adaptation to customer-specific requirements. The multicomponent filaments and the monocomponent filaments of the multicomponent spunbonded nonwoven according to the present invention are designed as solid or hollow filaments or as a mixture thereof. This makes it possible to influence the physical textile properties and to possibly save on expensive raw material, depending on the demand on the individual types of filaments and on the multicomponent spunbonded nonwoven made thereof.

According to the method of the present invention for manufacturing the multicomponent spunbonded nonwoven, at least two rows of spinning heads, having uniform spinning nozzle apertures, are provided, the multicomponent filaments having a different number of elementary filaments or a mixture with monocomponent filaments being produced in a common spinning and drawing device, lapped into a spunbonded nonwoven, bonded via hydro-fluid treatment, and split up into the elementary filaments. A mechanical or thermal pre-bonding process may precede hydro-fluid bonding. The method according to the present invention produces multicomponent spunbonded nonwovens, made up of layers having different filament titers and thereby combining physical textile properties which were previously only achievable by joining separately manufactured layers.

The method according to the present invention is advantageously refined in that, with respect to the conveyor belt, the sequence of the spinning machines is selected in such a way that a titer gradient of the filaments is achieved from one main side to the other main side of the multicomponent spunbonded nonwoven or, with respect to thickness, from the center of the multicomponent spunbonded nonwoven to the main sides of the multicomponent spunbonded nonwoven.

In the above-mentioned sense, the sequence of the spinning machines may also be selected in such a way that alternating, repetitive titer gradients are produced in the nonwoven's feed direction or transversal direction.

In this way, the method according to the present invention makes it possible to manufacture multicomponent spunbonded nonwovens specifically for different applications.

The spunbonded nonwovens according to the present invention are advantageously used for manufacturing textile products, imitation leather, polishing cloths, or filter media.

BRIEF DESCRIPTION OF THE DRAWINGS

FIG. 1 is a Table showing the results of tests performed on samples produced and split and bonded via fluid jet bonding as described in EP 0 814 188 B1.

FIG. 3 is a Table showing the results of tests performed on samples produced in accordance with Examples 1 and 2.

DETAILED DESCRIPTION

Figure 2:
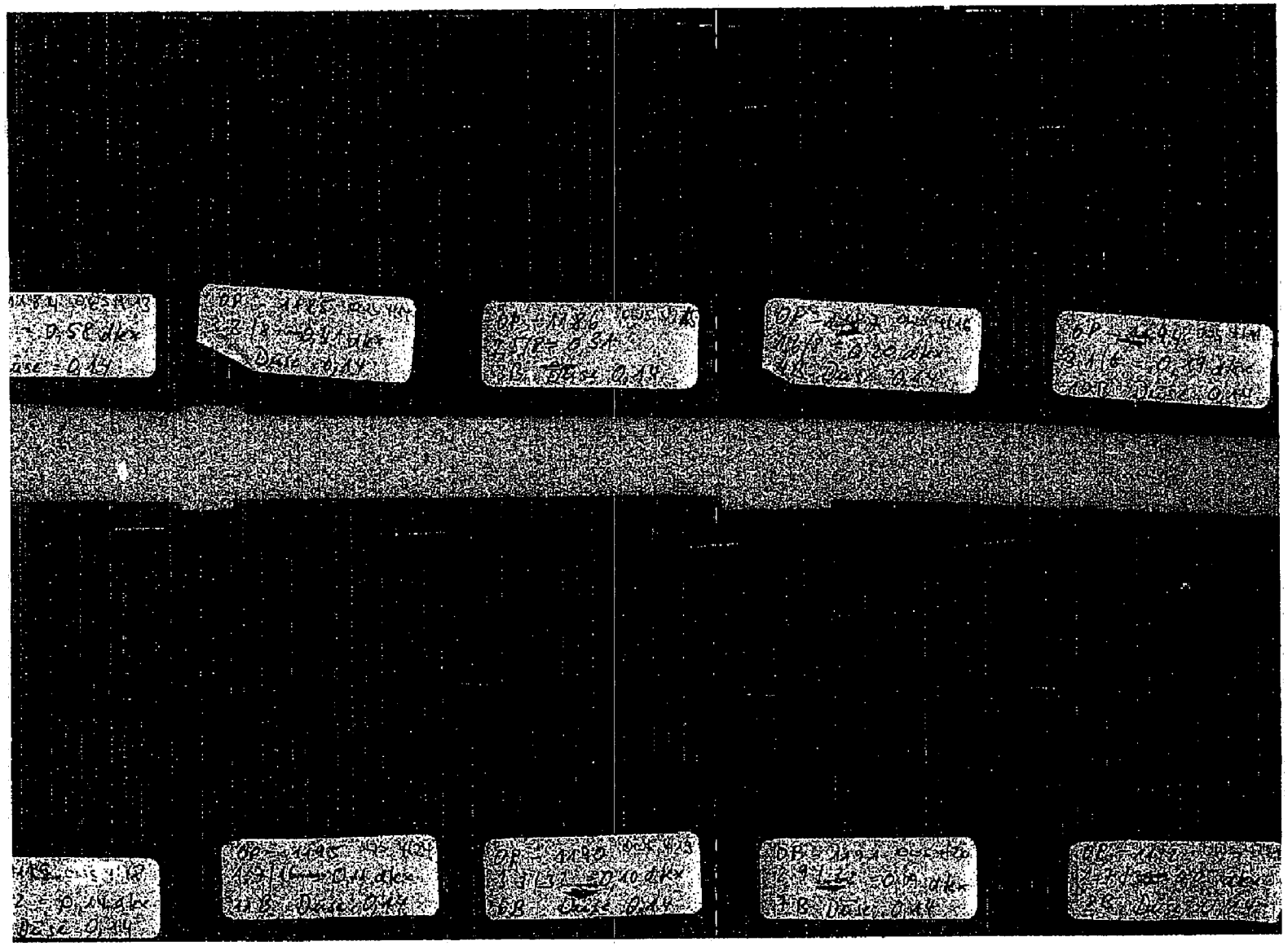
FIG. 2 is a photograph of the samples referenced in FIG. 1.

The present invention will now be explained in greater detail on the basis of the exemplary embodiments that follow.

The examples described below use two extruders which supply the spinning pumps upstream from the spinning packs with polymers via heated tubes with symmetrical geometry (length and diameter). Due to this arrangement, the same quantity of polymers, which have the same quantity ratio throughout (e.g., polyethylene terephthalate/polyamide 6 PET/PA6=70/30), arrives initially at all spinning pumps. The throughput and the quantity ratio of the polymers called up by the spinning pumps are variable, but not completely free, since the spinning positions communicate with one another via the tubing feed.

Although this arrangement is not obligatory, additional degrees of freedom could only be ensured via modifications of the spinning machine, resulting in greater freedoms in product design.

The subsequently described examples refer to bi-component filaments, made of PET and PA6, at the constant volume ratio PET/PA6=70/30, having varying filament numbers per spinning pack, and varying segment numbers per filament type per spinning pack. Extension of the machine freedoms (number of extruders, geometry of the tubes . . . ) in the above-described sense and other polymer pairs results in an expansion of the examples described in the following.

Comparative Example

Fabrics, Each Having a Uniform Titer

Under almost constant conditions with regard to the spinning and drawing conditions and under adapted storage conditions, with the object of the best possible conformity with regard to the mass per unit area of the fabrics having a uniform titer, samples are produced and split and bonded via fluid jet bonding as described in EP 0 814 188 B1. The object was to determine to what extent which physical textile properties of comparable fabrics are dependent on the titer of the filaments.

The results are shown in the table of FIG. 1, wherein:

On the filament, "Split titer" refers to the titer after fluid jet bonding and split up of the segments; "cN/Tex" refers to the tensile strength of the individual filament, drawn, but not split; "Elongation" refers to elongation of the individual filament, drawn, but not split; and On the fabric, "Look" refers to the evaluation of the look by grades (15=best); "Feel" refers to the feel evaluation by grades (15=best); "A" refers to side A; "B" refers to side B; "l" refers to longitudinal; "q" refers to transversal; "WRK" refers to tear growth resistance [N], normalized here to 1 g/m$^2$ mass per unit area; "HZK" refers to ultimate tensile strength [N/5 cm], normalized to 1 g/m$^2$; "Elongation" refers to the breaking elongation (l+q)/2; "Module (5% spec)" refers to the force at 5% elongation (l+q)/2; and "Abrasion" refers to abrasion resistance with evaluation of the look (internally, 1=best)

The table (categorized by decreasing titer after splitting) shows that:

1) The tensile strength and the elongation of the unsplit filaments vary in a normal range, a dependency on the titer after splitting is indiscernible;

2) The split degree seems to be able to be subdivided into two ranges, namely smaller or greater than 0.2 decitex;

3) The mass per unit areas vary from 100 g/m$^2$ to 117 g/m$^2$, the respective values, however, have been normalized to 1 g mass per unit area;

4) A direct dependency on the titer can be shown for the normalized tear growth resistance; this was qualitatively anticipated, but it cannot be quantitatively assessed;

5) A downward trend with a decreasing titer can also be shown for the normalized ultimate tensile strength, which was not anticipated since the materials and their modules are the same and the total cross-sectional area, which results from the sum of the individual filament cross-sectional areas, is also identical with equal or normalized mass per unit area.

6) The finer the titer, the better the bonding/interlacing via fluid jet bonding, as evidenced by the abrasion resistance; and 7) The trend of increasing abrasion resistance or pilling resistance with a decreasing titer may also be gathered from the surface roughness after dyeing (see FIG. 2).

It should be pointed out that the fabrics are solely bonded via fluid jet bonding (in the sense of felting), i.e., without any chemical or thermal bond.

Also in FIG. 1, * indicates that the "split titer" (titer after splitting) shown here is the averaged titer from both segment types. If the approximate same density of the two polymers is the underlying factor (PET approximately 1.38, PA6 approximately 1.13 g/m$^3$), a volume ratio of PET/PA ⅔:⅓ proves that the titer of the polyester segment must be twice as large as that of the polyamide segment.

Based on this and analog test series, an "optimized compromise of the properties" for industrial size production of microfilament fabrics has been provided which allows a preferably fine look, feel, and surface resistances without having to accept a decrease in, for example, the tear growth resistance or the ultimate tensile strength which are not able to meet the minimum requirements such as are required by the European Clothing Association Committee (ECLA).

EP 0 814 188 B1 describes a manufacturing method in which multicomponent filaments of different configurations are mentioned, but not the manufacture of fabrics made of multifilaments of different configuration within these fabrics. This further "degree of freedom" of the method may result in product advantages for many applications, some of which are subsequently described as examples.

Example 1

In-line isotropically distributed reinforcement in the center of the fabric for increasing the tear growth resistance:

Example 1(a)

The middle two layers are run as homofilaments with 70% PET and 30% PA, the number of spinning nozzles for PET and for PA6 having a ratio of 70:30, and the two monofilament layers having a titer of 2-2.6 decitex in the center of the fabric, and the other, in this case five layers with a PET/PA6 ratio of likewise 70/30, having a starting titer of 2.4 decitex and thus an average titer of 0.15 decitex after splitting of the sixteen segments. Using this procedure, the fabrics have a typical microfiber look and a typical microfiber feel on both sides.

While fabrics having a uniform titer of 0.15 decitex are sufficient to meet ECLA requirements for shirts, pajamas, T-shirts and the like with regard to tear growth resistance, this procedure also makes it possible to meet ECLA requirements for more tear growth-resistant garments such as trousers and jackets, as well as textile upper material for shoes without having to increase the mass per unit area.

Example 1(b)

The middle four layers are run as PIE 8 (polyiminoethylene) and the other four outer layers are run as PIE 16 with 70% PET and 30% PA. All filaments have a starting titer of 2.4 decitex and therefore obtain an average titer of 0.3 decitex and 0.15 decitex, respectively, after splitting of the 8 and 16 segments.

This procedure gives the fabrics a typical microfiber look and a typical microfiber feel on both sides. This procedure makes it possible to increase the tear growth resistance only slightly where it must be increased only gradually due to statistical fluctuations in the product or, for example, for garments in which, due to the high insulation capability typical for microfiber products, a lower mass per unit area is desired without being allowed to fall below certain minimum requirements, above all with regard to the tear growth resistance (e.g., light summer garments).

Example 2

In skin or leather, the collagen strands of lower lying layers of the tissue become ever finer from the bottom up. At least in the early years, nature ensures that the mechanical resistance and the youthful smoothness of the skin may be achieved simultaneously. This is to be emulated in tests with titer gradients across the thickness of the fabric from one side to the other:

Example 2(a)

Four layers of PIE 8 are laid down, followed by four layers of PIE 16, and four layers of PIE 32, each having a starting titer of approximately 2.5 decitex before splitting and a PET/PA6 ratio of 70/30 and symmetrical fluid jet bonding on both sides.

Using this procedure, demands on a fabric for an automated finish may be met. While a preferably fine titer is desired for a preferably fine and scratch-free finish, the increase in the titer in part of the layers was able to ensure the tear growth resistance necessary for making up. Due to the fact that the product is not manufactured symmetrically but rather with a titer gradient, it may be achieved that the side of the coarser titer may be glued to the finishing disc and removed again without the microfibers tearing off in the process and the repeatedly reusable adhesive surface being exceedingly contaminated by torn off fibers, while the side having the very fine titer of only 0.05 decitex produces optimum finishing results as illustrated in FIG. 3.

Example 2(b)

Two layers of homofilaments are laid down, followed by two layers of the same, two layers of PIE 8, two layers of PIE 16, and four layers of PIE 32, each having a starting titer of approximately 2.5 decitex before splitting and a PET/PA6 ratio of 70/30 and symmetrical fluid jet bonding on both sides.

This product is subsequently steeped using solved polyurethane, the polyurethane is coagulated, the product is dyed, the finishing side is polished, and the product is dyed again in order to obtain a high-quality suede-like material.

This design is based on natural leather. Excellent one-sided synthetic leather qualities with regard to look and feel may be achieved hereby, which simultaneously have excellent mechanical properties, which may be used for upper material for shoes, upholstered furniture, or also for car seats, without requiring a backing by a supporting, non-bulging fabric customary today.

What is claimed is:

1. A multicomponent spunbonded nonwoven comprising:

elementary filaments including a first or second polymer, the elementary filaments being derived from splitting a first multicomponent filament into a plurality of first elementary filaments that include the first polymer and a plurality of second elementary filaments that include the second polymer and a second multicomponent filament into a plurality of third elementary filaments that include the first polymer and a plurality of fourth elementary filaments that include the second polymer;

the first and the second elementary filaments being of first and second uniform titers, respectively, and the third and the fourth elementary filaments being of third and fourth uniform titers, respectively, that are less than the first and the second uniform titers; and wherein the titer of each of the elementary filaments depends on the number of elementary filaments derived from the respective multicomponent filament from which each of the elementary filaments is derived, wherein the elementary filament are arranged within the multicomponent spunbonded nonwoven such that the multicomponent spunbonded nonwoven has a titer gradient along the z direction of the sheet-like multicomponent spunbonded nonwoven.

2. The multicomponent spunbonded nonwoven as recited in claim 1, wherein 2 to 64 elementary filaments which have a titer in the range of 0.05 decitex to 4.8 decitex are derived from each multicomponent filament.

3. The multicomponent spunbonded nonwoven as recited in claim 1, wherein the elementary filaments are derived from multicomponent filaments have a starting titer in the range of 1.5 decitex to 5 decitex.

4. The multicomponent spunbonded nonwoven as recited in claim 1, wherein the polymers contain insoluble additives such as pigments, fillers, light protective agents, as well as soluble additives.

5. The multicomponent spunbonded nonwoven as recited in claim 1, wherein the elementary filaments are derived from multicomponent filaments that are solid filaments, hollow filaments, or a mixture of solid and hollow filaments.

6. The multicomponent spunbonded nonwoven as recited in claim 1, wherein a volume of the first polymer in the first elementary filaments is equal to a volume of the second polymer in the third elementary filaments and a volume of the second polymer in the second elementary filaments is equal to a volume of the second polymer in the fourth elementary filaments.

7. A multicomponent spunbonded nonwoven comprising:

a mixture of monocomponent filaments and elementary filaments, the mixture including at least two polymers, the elementary filaments being derived from splitting a plurality of multicomponent filaments;

wherein the titer of each of the elementary filaments depends on the number of elementary filaments that are derived from the respective multicomponent filaments from which each elementary filament is derived, wherein the monocomponent filaments and the elementary filaments are arranged within the multicomponent spunbonded nonwoven such that the multicomponent spunbonded nonwoven has a titer gradient along the z direction of the sheet-like multicomponent spunbonded nowoven.

8. The multicomponent spunbonded nonwoven as recited in claim 7, wherein 2 to 64 elementary filaments which have a titer in the range of 0.05 decitex to 4.8 decitex are derived from each multicomponent filament.

9. The multicomponent spunbonded nonwoven as recited in claim 7, wherein the elementary filaments are derived from multicomponent filaments have a starting titer in the range of 1.5 decitex to 5 decitex.

10. The multicomponent spunbonded nonwoven as recited in claim 7, wherein elementary filaments are derived from multicomponent filaments that each include the same weight ratio of the at least two polymers as each of the monocomponent filaments.

11. The multicomponent spunbonded nonwoven as recited in claim 7, wherein the polymers contain insoluble additives such as pigments, fillers, light protective agents, as well as soluble additives.

12. The multicomponent spunbonded nonwoven as recited in claim 7, wherein the multicomponent filaments and the monocomponent filaments are solid filaments, hollow filaments, or a mixture of solid and hollow filaments.

13. The multicomponent spunbonded nonwoven as recited in claim 7, wherein the elementary filaments all are derived from multicomponent filaments of the same titer.

14. The multicomponent spunbonded nonwoven as recited in claim 7, wherein each of the monocomponent filaments and each of the elementary filaments include only one of the at least two polymers.

15. A multicomponent spunbonded nonwoven comprising:

a mixture of monocomponent filaments and elementary filaments, the mixture including at least two polymers, the elementary filaments being derived from splitting a plurality of multicomponent filaments;

wherein the titer of each of the elementary filaments depends on the number of elementary filaments that are derived from the respective multicomponent filaments from which each elementary filament is derived, wherein the first elementary filaments, second elementary filaments, the third elementary filaments and the fourth elementary filaments are arranged within the multicomponent spunbonded nonwoven such that the first and second elementary filaments form middle layers of the multicomponent spunbonded nonwoven and the third and fourth elementary filaments form outer layers of the multicomponent spunbonded nonwoven.

16. A multicomponent spunbonded nonwoven comprising:

a mixture of monocomponent filaments and elementary filaments, the mixture including at least two polymers, the elementary filaments being derived from splitting a plurality of multicomponent filaments;

wherein the titer of each of the elementary filaments depends on the number of elementary filaments that are derived from the respective multicomponent filaments from which each elementary filament is derived, wherein the monocomponent filaments and the elementary filaments are arranged within the multicomponent spunbonded nonwoven such that the monocomponent filaments are the center of the multicomponent spunbonded nonwoven.

17. The multicomponent spunbonded nonwoven as recited in claim 16, wherein 2 to 64 elementary filaments which have a titer in the range of 0.05 decitex to 4.8 decitex are derived from each multicomponent filament.

18. The multicomponent spunbonded nonwoven as recited in claim 16, wherein the elementary filaments are derived from multicomponent filaments have a starting titer in the range of 1.5 decitex to 5 decitex.

19. The multicomponent spunbonded nonwoven as recited in claim 16, wherein elementary filaments are derived from multicomponent filaments that each include the same weight ratio of the at least two polymers as the monocomponent filaments.

20. The multicomponent spunbonded nonwoven as recited in claim 16, wherein the polymers contain insoluble additives such as pigments, fillers, light protective agents, as well as soluble additives.

21. The multicomponent spunbonded nonwoven as recited in claim 16, wherein the multicomponent filaments and the monocomponent filaments are solid filaments, hollow filaments, or a mixture of solid and hollow filaments.

22. The multicomponent spunbonded nonwoven as recited in claim 16, wherein the elementary filaments all arc derived from multicomponent filaments of the same titer.

23. The multicomponent spunbonded nonwoven as recited in claim 16, wherein each of the monocomponent filaments and each of the elementary filaments include only one of the at least two polymers.

* * * * *